US007389718B1

(12) United States Patent
Carter et al.

(10) Patent No.: US 7,389,718 B1
(45) Date of Patent: Jun. 24, 2008

(54) BALLISTIC BLANKET

(76) Inventors: Gerald D. Carter, 2307 Duval Dr., Monroe, LA (US) 71201; Paul Carter, 3017 River Oaks Dr., Monroe, LA (US) 71201

( * ) Notice: Subject to any disclaimer, the term of this patent is extended or adjusted under 35 U.S.C. 154(b) by 52 days.

(21) Appl. No.: 11/457,000

(22) Filed: Jul. 12, 2006

Related U.S. Application Data

(60) Provisional application No. 60/720,179, filed on Sep. 23, 2005.

(51) Int. Cl.
*F41H 1/02* (2006.01)
*F41H 13/00* (2006.01)

(52) U.S. Cl. ..... 89/36.02; 89/36.04; 89/36.05; 2/2.5

(58) Field of Classification Search ..... 89/36.02, 89/36.04, 36.05, 36.01, 36.07; 2/2.5
See application file for complete search history.

(56) References Cited

U.S. PATENT DOCUMENTS 2,326,713 A * 8/1943 Wesseler ..... 89/36.02
4,292,882 A 10/1981 Clausen
4,391,178 A 7/1983 Pagano
4,868,040 A 9/1989 Hallal et al.
4,879,165 A 11/1989 Smith
5,060,553 A 10/1991 Jones
5,448,938 A * 9/1995 Fernandez et al. ..... 89/36.02
5,512,348 A 4/1996 Mazelsky
5,514,457 A 5/1996 Fels et al.
5,663,520 A 9/1997 Ladika et al.
5,686,689 A 11/1997 Snedeker et al.
5,804,757 A 9/1998 Wynne
5,939,658 A 8/1999 Muller
5,996,115 A * 12/1999 Mazelsky ..... 2/2.5
6,161,462 A * 12/2000 Michaelson ..... 89/36.01
6,497,966 B2 12/2002 Cohen et al.
6,510,777 B2 * 1/2003 Neal ..... 89/36.05
6,526,862 B1 3/2003 Lyons
6,601,497 B2 8/2003 Ghiorse et al.
6,609,452 B1 8/2003 McCormick et al.
6,627,562 B1 9/2003 Gehring, Jr.
6,651,543 B2 11/2003 Park
6,679,157 B2 1/2004 Chu et al.
6,696,128 B2 * 2/2004 McIntee et al. ..... 428/102
6,705,197 B1 3/2004 Neal
6,846,545 B2 1/2005 Thomas
6,862,970 B2 3/2005 Aghajanian et al.

(Continued)

OTHER PUBLICATIONS

Product Sheet—Honeywell, Spectra Shield Plus, www.spectrafiber.com.

(Continued)

*Primary Examiner*—Bret Hayes
(74) *Attorney, Agent, or Firm*—Coats & Bennett, P.L.L.C.

(57) ABSTRACT

A ballistic blanket is provided and includes a pliable outer shell or housing that encompasses an inner ballistic core which is housed or contained within an inner shell or housing. Secured to exterior portions of the ballistic blanket are a series of handles and one or more attaching straps or buckles that facilitate the securement of devices such as a carrier panel. In one design, the interior ballistic core comprises a high performance fiber such as an aramid fiber, high molecular weight polyethylene, a combination of high performance fiber types, or a non-woven thermoplastic composite.

23 Claims, 4 Drawing Sheets

U.S. PATENT DOCUMENTS

| | | | | |
|---|---|---|---|---|
| 6,892,623 | B2 | 5/2005 | Benyami et al. | |
| 6,899,009 | B2 * | 5/2005 | Christiansen et al. | 89/36.02 |
| 6,920,817 | B2 | 7/2005 | Ravid et al. | |
| 6,961,957 | B2 * | 11/2005 | Carlson | 2/2.5 |
| 2002/0017310 | A1 | 2/2002 | Gruenbacher et al. | |
| 2003/0200861 | A1 | 10/2003 | Cordova et al. | |

OTHER PUBLICATIONS

DSM, Dyneema, http://www.dsm.com.en_US/html/hpf/ 19 total pages.

Product Sheet—Honeywell, Spectra Shield Plus LCR, www.spectrafiber.com.

Honeywell Advanced Fibers and Composites, http://www.honeywell.com/sites/afc/armor3, 3 total pages.

* cited by examiner

BALLISTIC BLANKET

This application claims priority to U.S. Provisional Patent Application No. 60/720,179 filed Sep. 23, 2005, which is incorporated herein by reference.

FIELD OF INVENTION

The present invention relates to anti-ballistic protection systems, and more particularly to a versatile ballistic blanket that is of a relatively lightweight construction and which can be readily carried by an individual.

BACKGROUND

Ballistic protection systems are widely used throughout the world in military, police and security applications. The range and types of anti-ballistic protection systems are vast. For example, there is a wide range of heavy duty anti-ballistic protection devices that are commonly employed on and around military vehicles. Much attention has also been given to the individual soldier or policeman. In that regard, much research and development has been devoted to providing improved body armor, for example, in the form of improved helmets, anti-ballistic vests, bulletproof chest protectors, etc.

Ballistic protection systems are widely used throughout the world in military, police and security applications. The range and types of anti-ballistic protection systems are vast. For example, there is a wide range of heavy duty anti-ballistic protection devices that are commonly employed on and around military vehicles. Much attention has also been given to the individual soldier or policeman. In that regard, much research and development has been devoted to providing improved body armor, for example, in the form of improved helmets, anti-ballistic vests, bulletproof chest protectors, etc.

The commercially available pliable and flexible ballistic materials (also known as soft armor) are composed of high performance fibers such as polyethylene, ultra-high molecular weight polyethylene, and the family of aramid fibers. Current research shows development promise of additional fibers and compounds into this group of high performance fibers. This soft armor material has traditionally been limited largely to military and law enforcement personal armor garments, large bomb blankets and limited applications for specialty operations personnel. These ballistic materials qualities such as ballistic effectiveness, flexibility, and pliability have been underutilized for other applications as there were no means of attaching, carrying, fastening, or fitting these materials to these other applications.

Therefore, there has been and continues to be a need for a versatile anti-ballistic protection device that can be configured to protect an individual for specific threat levels and can be carried by an individual and which is designed for a wide range of uses and applications.

SUMMARY OF THE INVENTION

The present invention relates to a ballistic blanket or cover having an outer pliable shell or housing. Disposed within the outer shell is an inner ballistic core that is in turn housed within an inner shell or housing.

In one particular embodiment or design, the ballistic blanket is provided with a series of exterior handles, and a series of fasteners for securing a device such as a carrying panel to the ballistic blanket.

Further, in one particular embodiment, the inner ballistic core comprises a non-woven polyethylene fiber that is sometimes referred to as a high molecular weight polyethylene core or a non-woven thermoplastic composite.

Other objects and advantages of the present invention will become apparent and obvious from a study of the following description and the accompanying drawings which are merely illustrative of such invention.

DETAILED DESCRIPTION

Figure 1:
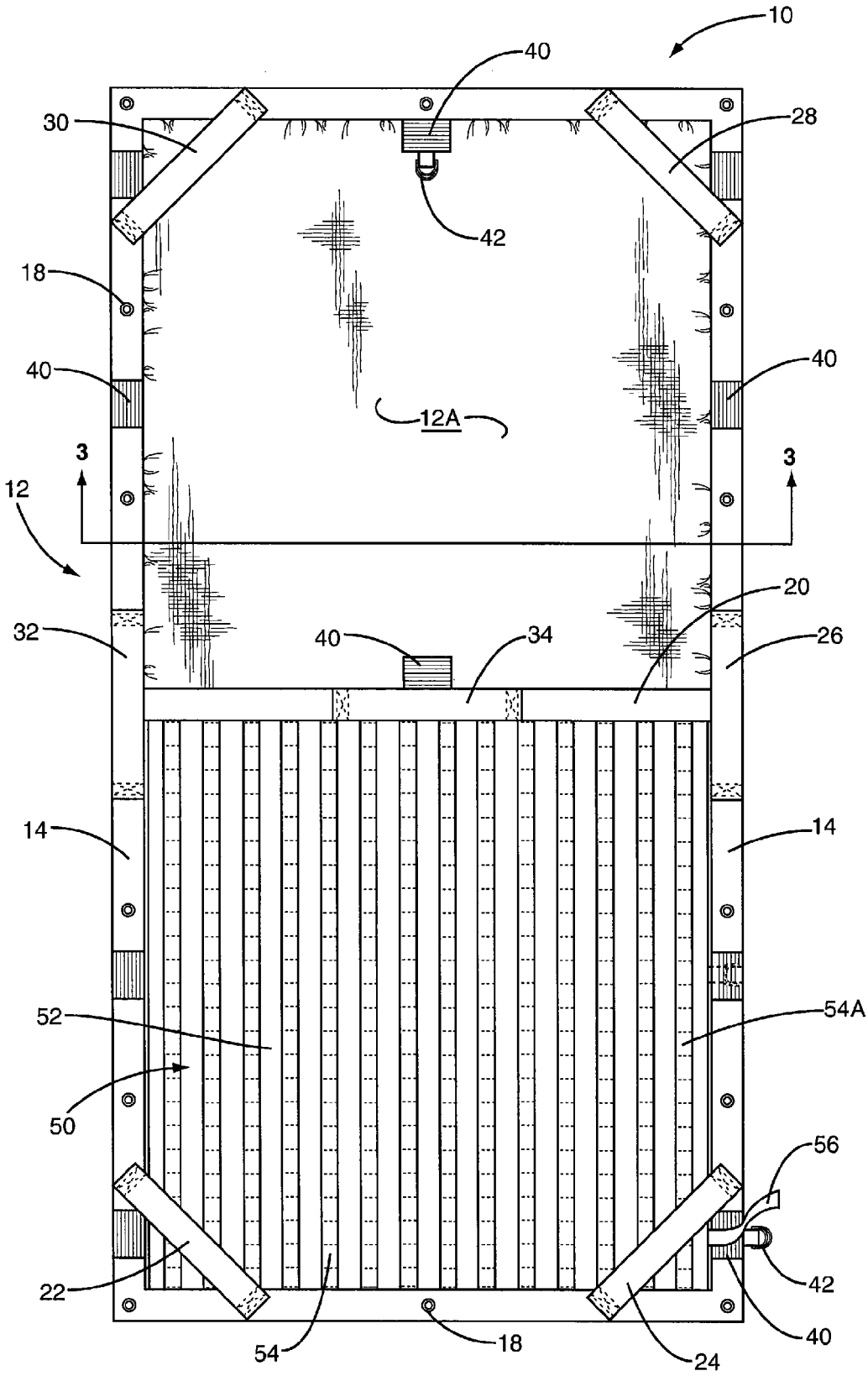
FIG. 1 is a top plan view of one side of the ballistic blanket of the present invention.

With further reference to the drawings, the ballistic blanket is shown therein and indicated generally by the numeral 10. As detailed below, the ballistic blanket 10 comprises a pliable structure that can be employed in various ways to provide ballistic protection. Generally the ballistic blanket 10 includes an outer shell or housing, indicated generally by the numeral 12, that holds an inner housing or shell 60 that in turn encompasses and holds a ballistic core 62 which, in the case of one embodiment, comprises an aramid fiber panel, high molecular weight polyethylene fiber panel, a combination of high performance fibers, or a non-woven thermoplastic composite. As will be appreciated from subsequent portions of this disclosure, the ballistic blanket 10 can be carried by a single person and placed in various locations and positions and can even be wrapped around a human or other object that is to be protected.

Turning to a more detailed discussion of the ballistic blanket 10, as seen in the drawings, the outer shell or housing 12 assumes a generally rectangular shape. It is to be appreciated that the shape and size of the ballistic blanket 10 can vary. Any number of suitable materials can be utilized to construct the outer housing 12. For example, suitable materials would include fabrics, vinyl, leather and other pliable synthetic materials.

Figure 2:
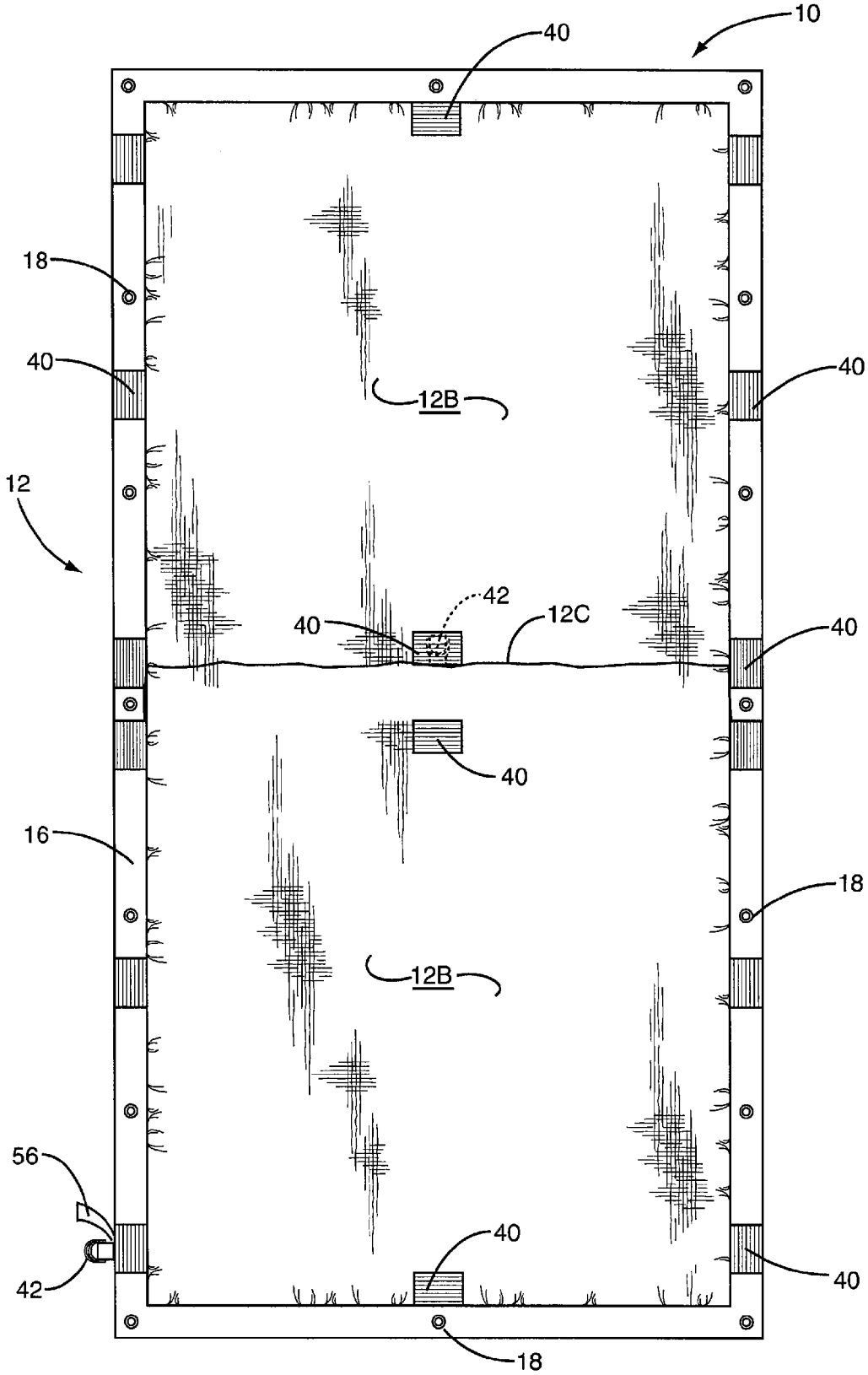
FIG. 2 is a plan view of the other side of the ballistic blanket.

In the case of the embodiment illustrated herein, the ballistic blanket 10 is relatively thin compared to its length and width. The outer shell or housing 12 includes a first side 12A (FIG. 1) and a second side 12B (FIG. 2). Second side 12B is split into two sections. As seen in FIG. 2 there is shown a terminal edge 12C that extends transversely across the back of the ballistic blanket 10 approximately mid way opposite ends thereof. In the design illustrated in the drawings, access to the interior area of the ballistic blanket 10 can be gained through an opening that lies adjacent and just underneath the edge 12C. However, the two backside sections 12B, as shown in FIG. 2, are secured at a point generally mid way the opposite edges of the ballistic blanket 10 by a strap and buckle arrangement.

Extending around the perimeter of the ballistic blanket 10 is a number of perimeter straps. As seen in FIG. 1, there is provided a perimeter strap 14 that extends continuously around the perimeter of the blanket including both sides and both ends. As seen in FIG. 2, a second perimeter strap 16 extends around the backside of the blanket 10 including the sides and opposed ends. As was the case with the front side of the ballistic blanket 10, this perimeter strap 16 extends continuously. Various types of material can be utilized for the perimeter straps 14 and 16. In one embodiment, these perimeter straps 14 and 16 can be constructed of webbing material such as that commonly used in seatbelt harnesses. However, as noted above, other suitable materials and types of construction can be utilized.

Perimeter straps 14 and 16 lay over and adjacent the outer edges of the first and second sides 12A and 12B. The edge portions of the first and second sides 12A and 12B extend into and between the straps 14 and 16. Straps 14 and 16 are sewn or stitched together, and in the process, effectively sandwich or secure the sides 12A and 12B between the straps 14 and 16.

One feature of the ballistic blanket 10 is that the blanket is designed to be used in various environments and applications. In some cases the ballistic blanket 10 may be secured or attached to other structures such as doors, walls, and vehicles. To accommodate and facilitate securing the ballistic blanket 10 to other structures and objects, the ballistic blanket 10 is provided with a series of spaced apart grommets 18 that are disposed around the perimeter of the blanket. In particular, the grommets 18 are secured through the perimeter straps 14 and 16 as shown in FIGS. 1 and 2.

To facilitate handling, ballistic blanket 10 is provided with a series of handles. In the case of the embodiment illustrated herein, each of the handles is constructed with an elongated strap that is secured at opposite ends to a portion of the blanket 10. As illustrated in FIG. 1, the handles are disposed across the first side 12A of the blanket 10. In the case of the design illustrated, the blanket is provided with seven different handles 22, 24, 26, 28, 30, 32 and 34. Note that handles 22, 24, 28 and 30 extend across opposed corner portions of the blanket. Handles 26 and 32 lie on opposite sides of the blanket about midpoint areas. Finally, handle 34 is secured on the center strap 20. The center strap 20 is similar to the perimeter straps 14 and 16 and provides a reinforcing structure that extends across the front side 12A of the blanket and generally connects at opposite ends to portions of the perimeter strap 14 formed about the first side 12A of the blanket.

Formed on both sides of the blanket 10 is a plurality of elastic pads 40. Some of the elastic pads 40 are secured on the perimeter straps 14 and 16, while other elastic pads 40 are secured to sides 12A and 12B. In any event, in a typical construction an elastic pad 40 is secured about opposite edges such that the area underlying the elastic pad can be accessed. That is, the non-attached edges or sides of the pads 40 permit ready access to the area underneath the pad.

Fasteners are secured adjacent to the respective pads 40. In some cases the fasteners or portions thereof underlie the pads 40. In cases where the pads 40 are disposed over perimeter straps 14 or 16, the fastener or a portion of the fastener can lie between the perimeter strap and the elastic pad 40.

Various types of fasteners can be utilized. In the case of the embodiment illustrated herein, the fasteners include strap buckles 42. Each strap buckle 42 includes a strap that is secured to the ballistic blanket 10 and a pair of rings secured to an end portion of the strap that is adapted to receive and securely attach to a connecting strap. As will be appreciated from subsequent portions of this disclosure the strap buckles 42 permit auxiliary and ancillary components to be secured to the ballistic blanket 10.

Various structures and carrying devices can be secured to the ballistic blanket 10. In the embodiment illustrated herein, the ballistic blanket 10 is adapted to receive a carrying device that is indicated generally by the numeral 50. In the case of the embodiment illustrated herein, the carrying panel 50 is secured to a portion of the first side 12A. Carrying panel 50 is a device that is commonly referred to as a molly panel. It includes a pliable backing 52 and a plurality of parallel strips 54. Each strip 54 includes a series of aligned segments with one segment following another segment. Every other segment in each line is secured on all edges to the backing 52. However, every other segment is open on the opposed side edges to form loops. The loops will, of course, permit attaching strips to be extended thereunder such that various components, equipment and supplies can be attached to the carrying panel 50. Carrying panel 50 also includes a series of straps 56. Straps 56 extend outwardly at various points from the carrying panel 50. These attaching straps 56 are adapted to be connected to selected strap buckles 42 that extend from the ballistic blanket 10. This permits the carrying panel 50 to be securely attached to the ballistic blanket 10.

Various devices and paraphernalia can be secured to the carrying panel 50. For example, in a military operation items such as canteens, night vision goggles, ammunition, food rations, radio equipment, etc. can be supported and carried by the carrying panel 50.

Figure 3:
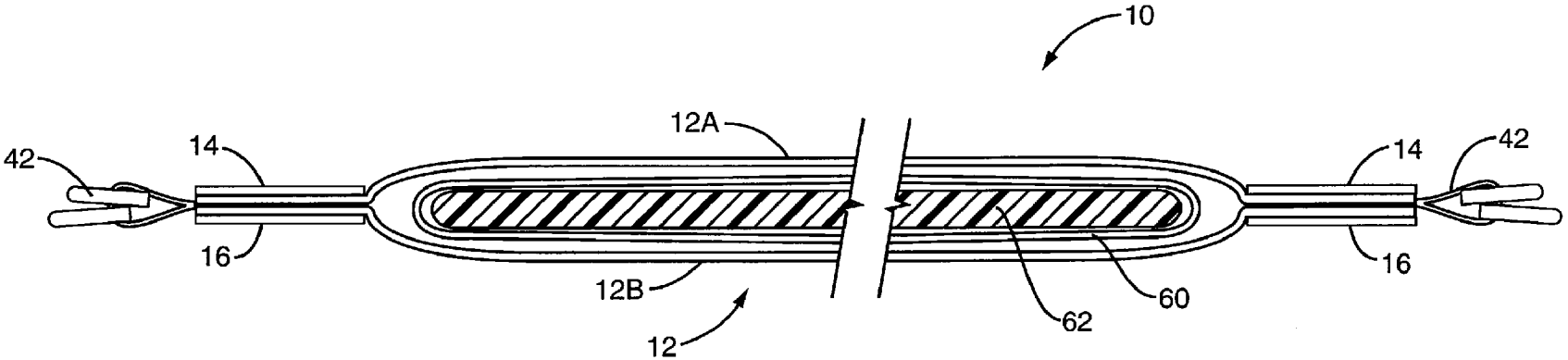
FIG. 3 is a cross sectional view taken through the line 3-3 of FIG. 1.
Figure 4:
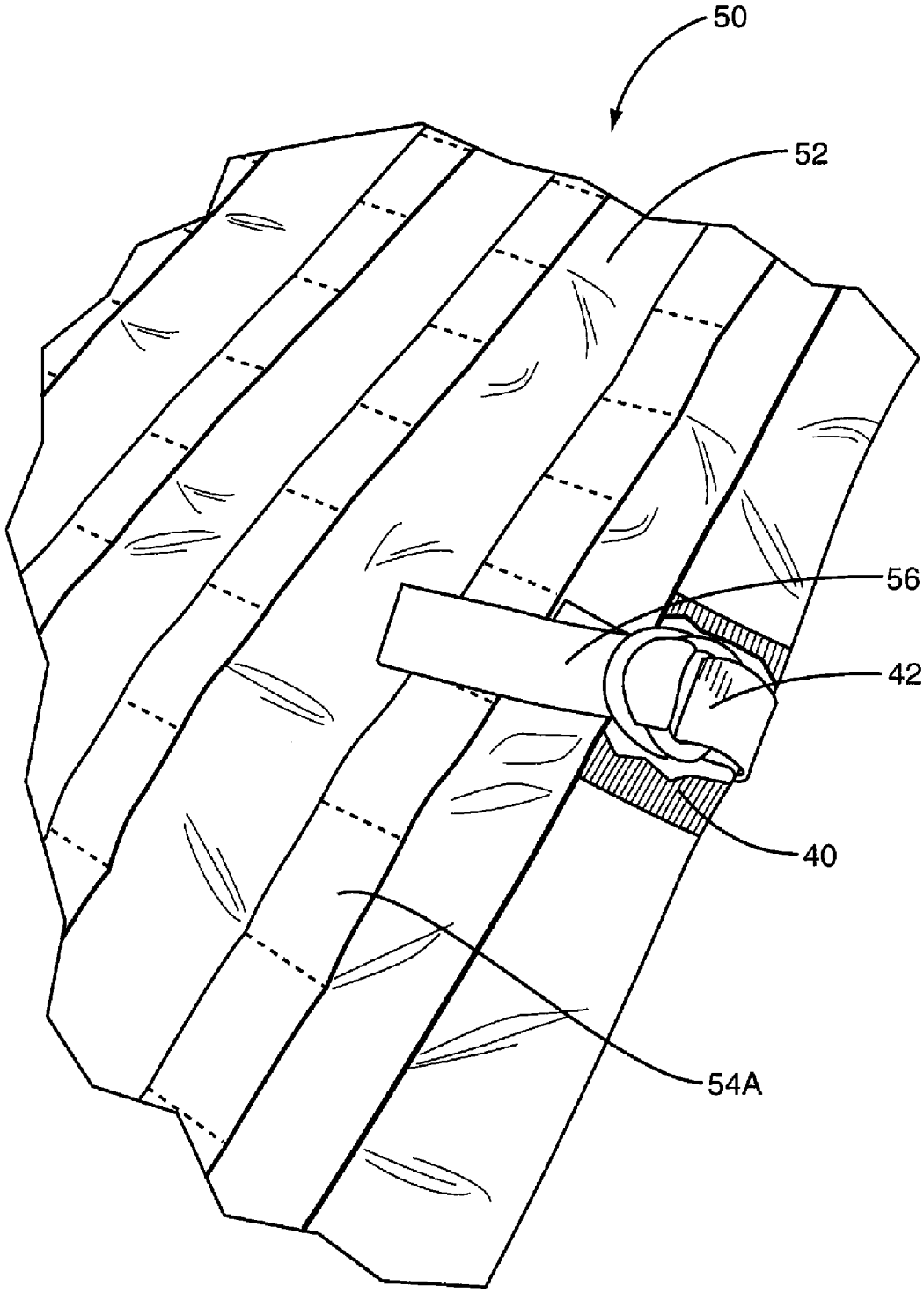
FIG. 4 is a fragmentary perspective view showing a portion of the ballistic blanket having a molly panel attached thereto.

Disposed interiorly of the outer housing or shell 12 is an inner ballistic core. This inner ballistic core includes an inner cover or shell 60 and a ballistic core 62. The ballistic core, as shown in FIG. 3, is housed or contained within the inner cover or shell 60. Ballistic core 62 in one embodiment comprises high performance fibers such as aramid fibers, a non-woven polyethylene fiber, or a combination of high performance fibers. This non-woven polyethylene material is sometimes referred to as a high molecular weight polyethylene core or a non-woven thermoplastic composite. These materials are commercially available and are, for example, sold under the trademarks: "Spectrashield" and "Dyneema." Typically such high molecular weight polyethylene cores comprise a plurality of piles of unidirectional polyethylene fiber. It is preferable that the ballistic core 62 be non-hygroscopic, abrasion resistant and generally be resistant to adverse chemical exposure. In addition, the ballistic core 62 should be suitable for use in a wide range of natural environments, such as alpine, jungle or desert, without compromising the integrity of the ballistic core. Both outer and inner shells 12 and 60 would be constructed of flame, moisture and abrasion resistant fabrics such as nylon cordura. The outer shells 12 would typically provide for greater or a first line defense to flame, moisture and abrasion.

The ballistic blanket 10 of the present invention has many uses. It, of course, has military use as well as police and security use. The ballistic blanket 10 can be used to protect an individual soldier or a group of soldiers. Because the ballistic blanket 10 is of a relatively light weight it can be easily carried and handled by an individual soldier.

The ballistic blanket 10 can be utilized for personal protection by simply wrapping the same around one's body. It can further be used by securing the same to a door, wall or other surrounding structure. It has numerous uses in vehicles, even armored vehicles. The ballistic blanket 10 can be placed adjacent the floorboard of a vehicle to protect against ballistic materials that are directed upwardly from underneath the vehicle. In addition, the ballistic blanket 10 can be placed over seat areas or hung from interior side panels or other areas of the vehicle. These are simply a few examples of the versatility that the ballistic blanket 10 possesses.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A versatile ballistic blanket, comprising:

an outer pliable blanket housing having an outer surface and an inner surface, and which forms a generally closed interior area, the outer housing being relatively thin compared to the length and width of the outer housing;

a non-rigid inner housing disposed in the interior area of the outer housing and generally surrounded by the outer housing;

a ballistic core contained within the inner housing and comprising high performance fibers selected from the group including a high molecular weight polyethylene material, an aramid fiber, a combination of high performance fibers, or a non-woven thermoplastic composite;

the outer housing including a perimeter and including a series of straps disposed around the perimeter of the outer housing;

a series of spaced apart grommets formed in the straps disposed around the perimeter of the outer housing;

a series of handles secured to the outer housing and spaced around portions of the outer housing;

a plurality of fasteners secured to the outer housing for fastening to other structures and securing the ballistic blanket to other structures; and a carrying panel for carrying devices and paraphernalia secured to the outer surface of the outer housing.

2. The ballistic blanket of claim 1 wherein the outer housing is constructed of material taken from the group including fabric, vinyl, leather, and pliable synthetic materials.

3. The ballistic blanket of claim 1 wherein the outer housing includes two sides with one side separated into at least two sections and wherein there is provided an access opening that permits access to the inner housing and wherein the access opening at least partially delineates the two sections.

4. The ballistic blanket of claim 1 wherein the outer housing is generally rectangular or square and includes two opposed sides, and wherein the straps are secured about outer portions of each side.

5. The ballistic blanket of claim 4 wherein at least two of the straps on both sides are sewn together so as to sandwich portions of both sides of the outer housing between straps.

6. The ballistic blanket of claim 1 where the outer housing includes a pair of side edges and a pair of end edges; and wherein the handles include a series of diagonal handles, each diagonal handle extending diagonally across a corner area of the outer housing and attaching at opposite ends to one end edge and one side edge of the outer housing.

7. The ballistic blanket of claim 6 wherein the handles further include one or more handles, with each handle having a pair of opposed ends secured to a respective side edge of the outer housing.

8. The ballistic blanket of claim 7 where at least one handle is secured to a transverse strap that extends transversely across two side edges of the outer housing.

9. The ballistic blanket of claim 8 including a series of elastic pads secured to the outer housing.

10. The ballistic blanket of claim 9 wherein the fasteners normally assume a position between the elastic pads and the outer housing and wherein the fasteners can be extended from a position underneath the elastic pads.

11. The ballistic blanket of claim 1 including elastic pads mounted over the straps and wherein the fasteners are mounted between the elastic pads and the straps, and wherein the fasteners can be extended from between the pads and straps so as to be secured to another structure.

12. The ballistic blanket of claim 1 wherein the carrying panel is a molly panel.

13. The ballistic blanket of claim 1 wherein the carrying panel includes a series of parallel strips with each strip including aligned segments, and wherein respective segments form open loops along opposite sides that permit devices or paraphernalia to be inserted within the loops and held therein.

14. The ballistic blanket of claim 1 wherein the ballistic core is a high performance fiber such as an aramid fiber, ultra-high molecular weight polyethylene, a combination of high performance fiber types and may be non-hygroscopic and abrasion resistant.

15. The ballistic blanket of claim 1 including a vehicle and wherein the ballistic blanket is secured to the vehicle.

16. A versatile ballistic blanket comprising:

an outer pliable blanket housing having an outer surface and an inner surface, and forming a generally closed interior area, wherein the outer housing is relatively thin compared to the length and width of the outer housing;

an inner housing disposed in the interior area of the outer housing and generally surrounded and enclosed by the outer housing;

a ballistic core contained within the inner housing; and wherein the ballistic core comprises a high performance fiber selected from the group including an aramid fiber, high molecular weight polyethylene material, a combination of high performance fibers, or a non-woven thermoplastic composite.

17. The ballistic blanket of claim 16 including a carrier panel secured to the outer housing.

18. The ballistic blanket of claim 17 including a series of spaced apart grommets formed in the outer housing; a plurality of fasteners secured to the outer housing and operative to connect to other objects and structures; and one or more handles secured to the outer surface of the outer housing.

19. The ballistic blanket of claim 16 including a series of spaced apart grommets formed in the outer housing, and a series of fasteners secured to the outer housing and extending therefrom for connecting to other objects and structures.

20. The ballistic blanket of claim 16 wherein the ballistic blanket is relatively thin compared to the length and width of the ballistic blanket; wherein the outer housing includes two opposed sides and a perimeter extending around the outer housing; and a series of straps secured around the perimeter of both sides of the outer housing.

21. A method of manufacturing a ballistic blanket, comprising:

forming a pliable outer housing having an outer surface and an inner surface and forming a generally closed interior area;

forming the ballistic blanket such that the blanket is thin compared to the length and width of the blanket;

inserting an inner housing into the interior area of the outer housing where the inner housing forms an enclosure and when inserted into the outer housing, the inner housing is surrounded and generally enclosed by the outer housing;

inserting a ballistic core into the inner housing such that the ballistic core is surrounded and enclosed by both the inner housing and the outer housing; and wherein inserting the ballistic core includes inserting a high performance fiber selected from the group including an aramid fiber, high molecular polyethylene material, a combination of high performance fibers, or a non-woven thermoplastic composite into the inner housing.

22. The method of claim 21 including inserting a series of grommets around a perimeter of the outer housing; securing a series of fasteners to the outer housing; and securing a series of handles to the outer housing.

23. The method of claim 21 including securing a series of handles to the outer housing wherein the series of handles includes at least one diagonal handle that extends across a corner area of the outer housing.

* * * * *

US007389718C1

(12) EX PARTE REEXAMINATION CERTIFICATE (8846th)

United States Patent

Carter et al.

(10) Number: US 7,389,718 C1

(45) Certificate Issued: Feb. 7, 2012

(54) BALLISTIC BLANKET

(76) Inventors: Gerald D. Carter, Monroe, LA (US); Paul Carter, Monroe, LA (US)

Reexamination Request:
No. 90/011,513, Feb. 28, 2011

Reexamination Certificate for:

| | |
|---|---|
| Patent No.: | **7,389,718** |
| Issued: | **Jun. 24, 2008** |
| Appl. No.: | **11/457,000** |
| Filed: | **Jul. 12, 2006** |

Related U.S. Application Data

(60) Provisional application No. 60/720,179, filed on Sep. 23, 2005.

(51) Int. Cl.
*F41H 1/02* (2006.01)
*F41H 13/00* (2006.01)

(52) U.S. Cl. ..... 89/36.02; 89/36.04; 89/36.05; 2/2.5

(58) Field of Classification Search ..... None
See application file for complete search history.

(56) References Cited

To view the complete listing of prior art documents cited during the proceeding for Reexamination Control Number 90/011,513, please refer to the USPTO's public Patent Application Information Retrieval (PAIR) system under the Display References tab.

*Primary Examiner*—Jeffrey R. Jastrzab

(57) ABSTRACT

A ballistic blanket is provided and includes a pliable outer shell or housing that encompasses an inner ballistic core which is housed or contained within an inner shell or housing. Secured to exterior portions of the ballistic blanket are a series of handles and one or more attaching straps or buckles that facilitate the securement of devices such as a carrier panel. In one design, the interior ballistic core comprises a high performance fiber such as an aramid fiber, high molecular weight polyethylene, a combination of high performance fiber types, or a non-woven thermoplastic composite.

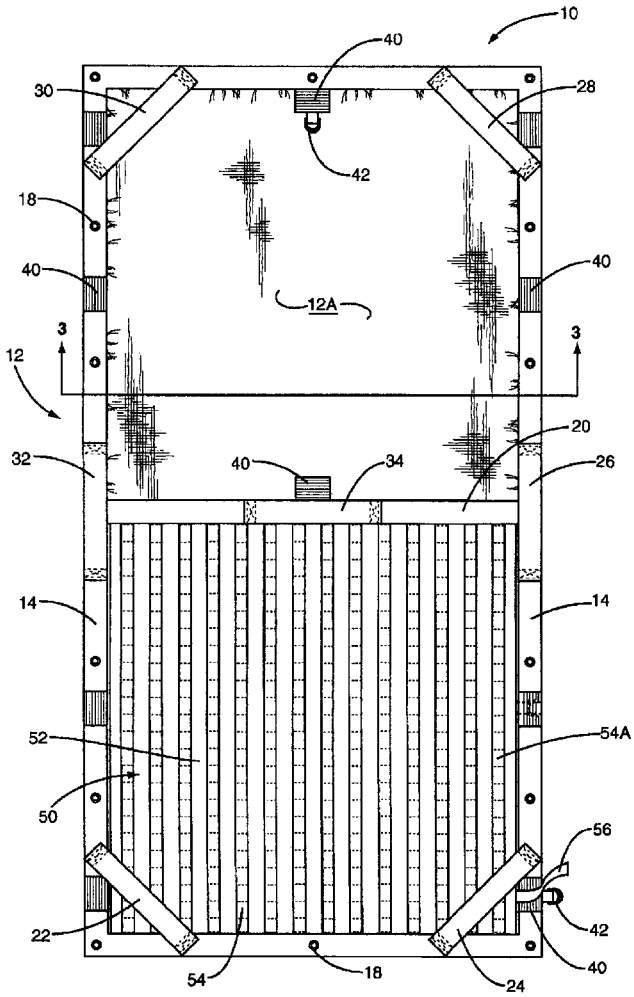

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 9-11 is confirmed.

Claims 1-8 and 12-23 are cancelled.

* * * * *